US010961947B2

(12) United States Patent
Gaiselmann

(10) Patent No.: US 10,961,947 B2
(45) Date of Patent: Mar. 30, 2021

(54) CYLINDER LINER

(71) Applicant: Mahle International GmbH, Stuttgart (DE)

(72) Inventor: Stefan Gaiselmann, Stuttgart (DE)

(73) Assignee: Mahle International GmbH

( * ) Notice: Subject to any disclaimer, the term of this patent is extended or adjusted under 35 U.S.C. 154(b) by 0 days.

(21) Appl. No.: 16/496,408

(22) PCT Filed: Mar. 13, 2018

(86) PCT No.: PCT/EP2018/056279
§ 371 (c)(1),
(2) Date: Sep. 20, 2019

(87) PCT Pub. No.: WO2018/172144
PCT Pub. Date: Sep. 27, 2018

(65) Prior Publication Data

US 2020/0378332 A1 Dec. 3, 2020

(30) Foreign Application Priority Data

Mar. 21, 2017 (DE) ..... 10 2017 204 720

(51) Int. Cl.
*F02F 1/00* (2006.01)

(52) U.S. Cl.
CPC ..... *F02F 1/004* (2013.01)

(58) Field of Classification Search
CPC ..... F02F 1/004; F02F 1/16; F02F 1/20; F16J 10/04
See application file for complete search history.

(56) References Cited

U.S. PATENT DOCUMENTS 2,387,971 A * 10/1945 Aspin ..... F16J 10/04 138/147
4,617,070 A * 10/1986 Amende ..... C21D 1/09 148/321
5,630,953 A 5/1997 Klink
9,915,220 B2 3/2018 Meirelles Tomanik
(Continued)

FOREIGN PATENT DOCUMENTS

DE 43 16 012 A1 11/1994
DE 10 2007 032 370 A1 1/2009
(Continued)

OTHER PUBLICATIONS

English abstract for DE-10 2007 032 370.
(Continued)

*Primary Examiner* — Joseph J Dallo
*Assistant Examiner* — Kurt Philip Liethen
(74) *Attorney, Agent, or Firm* — Fishman Stewart PLLC

(57) ABSTRACT

A cylinder liner for an internal combustion engine may have a running surface, in which by honing directed honing grooves may be introduced. The running surface may have a first region and a second region, wherein the first region may have a roughness that may be distinct from a roughness of the second region. A transition between the first region and the second region may proceed obliquely to a cylinder longitudinal axis at least in some portions. At least some of the honing grooves at the transition between the first region and the second region are uninterrupted.

20 Claims, 3 Drawing Sheets

(56) References Cited

U.S. PATENT DOCUMENTS

| | | | | |
|---|---|---|---|---|
| 2004/0226402 | A1* | 11/2004 | Fuchs | C25D 5/02 74/828 |
| 2014/0182540 | A1* | 7/2014 | Johansson | F02F 1/24 123/193.2 |
| 2015/0192063 | A1* | 7/2015 | Chang | F01M 11/02 123/193.2 |
| 2017/0009888 | A1* | 1/2017 | Pegg | F16J 10/02 |
| 2017/0167430 | A1* | 6/2017 | Bettini Rabello | F02F 1/20 |
| 2018/0106210 | A1* | 4/2018 | Hunter | F02B 75/28 |
| 2019/0085787 | A1* | 3/2019 | Bettini Rabello | F02F 1/20 |

FOREIGN PATENT DOCUMENTS

| | | | |
|---|---|---|---|
| DE | 10 2012 007 264 | A1 | 3/2013 |
| DE | 11 2014 003 421 | T5 | 6/2016 |
| JP | S60 128964 | A | 7/1985 |
| JP | 2004-176 556 | A | 6/2004 |
| WO | WO-2015/192 943 | A1 | 12/2015 |

OTHER PUBLICATIONS

English abstract for JP-S60 128964.
English abstract for DE-10 2012 007 264.
English abstract for JP-2004-176 556.

* cited by examiner

CYLINDER LINER

CROSS-REFERENCE TO RELATED APPLICATIONS

This application claims priority to International Patent Application No. PCT/EP2018/056279, filed on Mar. 13, 2018, and German Patent Application No. DE 10 2017 204 720.8, filed on Mar. 21, 2017, the contents of both of which are hereby incorporated by reference in their entirety.

TECHNICAL FIELD

The invention relates to a cylinder liner for an internal combustion engine having a running surface, in which honing grooves directed by honing are introduced and which has a first region and a second region, wherein the first region has a roughness that is distinct from that of the second region.

BACKGROUND

Such cylinder liners are known from the prior art. The honing grooves form an oil retention volume on the running surface. In addition, the oil can spread along the honing grooves so that the entire running surface is adequately supplied with oil. Reducing the roughness in a center region, in which the piston reaches its highest velocity, causes less frictional power and thus losses to be created. By contrast, a greater roughness value can be formed in a region, which corresponds to the top or bottom dead center, in which the piston velocity is very low, in order to form an enlarged oil retention volume. Especially in the top and bottom dead center, mixed friction effects occur by way of which a greater wear on the cylinder liner and on the piston rings generally also occurs. By way of the greater roughness value and thus the enlarged oil retention volume in the top dead center, the wear can be substantially reduced.

Disadvantageous in this is that an abrupt transition between a region with high roughness value and a region with low roughness value is present, so that a kind of edge is formed over which the piston rings have to slide during every working cycle. This suddenly reduces the oil retention volume of the honing grooves so that oil film interruptions can develop which in the worst case result in an oil shortage of the piston rings. This oil shortage can result in a failure of the piston ring and thus in the failure of the entire internal combustion engine.

SUMMARY

The present invention is based on the object of providing an improved or at least another embodiment of a cylinder liner which is characterized in particular by a reduced load on the cylinder liner and the piston rings.

According to the invention, this object is solved through the subject of the independent claims. Advantageous further developments are subject of the dependent claims.

The invention is based on the general idea that a transition between the first region and the second region proceeds obliquely to a cylinder longitudinal axis at least in some portions, and that at least some, preferentially most, of the honing grooves at the transition between the first region and the second region are not interrupted. By way of the oblique transition, the piston rings do not slide over the transition over the entire circumference simultaneously. When the piston rings slide over the transition, the first region with greater roughness and thus greater oil retention volume and the second region with lesser roughness and thus lesser oil retention volume are thus, seen in the circumferential direction, alternately present under the piston rings. Equalizing the oil volume between the regions of different roughness takes place because of the uninterrupted honing grooves. Because of this, oil can flow via the honing grooves between the two regions so that an adequate oil film is also present in the second region. By way of this, an oil film that is optimized for the transition region is provided which prevents an oil shortage, as a result of which the load on the cylinder liner and the piston rings can be reduced.

In the description and the attached claims, "oblique" means "not parallel" and in particular "not perpendicular". In particular, "oblique" means a deviation of at least 5°, preferentially at least 10° from parallel and perpendicular.

In the description and the attached claims, roughness is to mean the mean peak-to-valley height $R_z$, which is utilized when comparing roughnesses.

In the description and the attached claims, the expression "most honing grooves", means "more than 50% of the deep honing grooves".

It is to be understood that the transition between the first region and the second region has a finite width. Although this is small, the roughness will not abruptly merge.

A favorable possibility provides that the transition between the first region and the second region proceeds alternatingly at least in some portions. By way of this, multiple extreme values can be achieved during the course of the transition so that the effect of the circumferential honing grooves, which from the first region with high roughness, via the transition region to the second region, continuously proceed with low roughness, can be better utilized. By way of this, a local equalization of the oil film thickness can take place which leads to a flow-favorable distribution of the oil film.

A particularly favorable possibility provides that the transition between the first region and the second region proceeds periodically at least in some portions. By way of this special form of an alternating course a particularly defined equalization of the oil film thickness can be achieved.

A further favorable possibility provides that the transition between the first region and the second region proceeds wave-like at least in some portions. Thus, it can be achieved in a simple manner that the transition substantially proceeds the entire time obliquely to the cylinder axis thereby improving the local equalization of the oil film thickness.

A further particularly favorable possibility provides that the transition between the first region and the second region proceeds zigzag-shaped at least in some portions. By way of this it can also be achieved that the course of the transition proceeds obliquely to the cylinder longitudinal axis. In particular, the course has very small portions or no portions that proceed perpendicularly to the cylinder longitudinal axis.

An advantageous solution provides that an axial extent of a course of the transition between the first region and the second region defines a transition region between the first region and the second region, and that the transition region between the first region and the second region has an axial expanse that is greater than 0.5 mm, but which is less than 40 mm, preferentially less than 15 mm. By way of this, an adequate space is provided at the transition between the first region and the second region so that the described oil distribution along the honing grooves is made possible. Nevertheless, the transition is thus limited to a finite region of the cylinder running surface so that the advantages of the regions with different roughnesses can still be utilized.

A further advantageous solution provides that the first region and the second region are axially adjacent to one another. Accordingly the second region for example can lie in the center of the cylinder liner and the first region at an axial end of the cylinder liner, so that in the region of one of the dead centers the piston rings are in contact with the first region of the running surface.

A further particularly advantageous solution provides that the second region lies axially centrically and the first region lies axially eccentrically, and that the first region has a roughness that is greater than a roughness of the second region. Thus, the region of the top dead center or the region in which the piston rings are in contact with the running surface, when the piston is located in the region of the top dead center, has a greater roughness and thus a greater oil retention volume.

In the description and the attached claims, "axially centrically" is to mean a region comprising the axial center. Here, the axial center relates to the axial expanse of the cylinder liner. Alternatively, the center can also be defined as center between the places on the cylinder running surface in which the piston rings are located in the top and bottom dead center.

In the description and the attached claims, "axial eccentrically" is to mean a region not comprising the axial center.

A favorable version provides that the running surface comprises a third region which has a roughness that is greater than the roughness of the second region, and that the third region is arranged eccentrically, adjoins the second region and based on an axial center lies opposite the first region. Because of this, the second region is arranged between the first region and the third region.

A further favorable version provides that a transition between the second region and the third region proceeds obliquely to a cylinder longitudinal axis at least in some portions. In this way, the risk of an oil shortage of the piston rings when sliding over the transition can also be reduced in the case of the second transition.

An advantageous possibility provides that the transition between the second region and the third region proceeds alternatingly at least in some portions. Because of this, multiple extreme values can be generated so that during the movement of the piston the piston rings come in contact with the transition at multiple points more or less simultaneously without entering into contact with the transition over the entire circumferential region simultaneously. Thus, an improved oil equalization between the second region and the third region can thereby be achieved when the piston rings slide over the transition.

A particularly favorable possibility provides that the transition between the second region and the third region proceeds periodically at least in some portions. Through this special form of an alternating course a particularly defined equalization of the oil film thickness can be achieved.

A favorable solution provides that the transition between the second region and the third region proceeds wave-like at least in some portions. Accordingly, a wave-like course is a simple possibility of achieving an alternating course so that by way of this the risk of an oil shortage of the piston rings can be reduced in a simple manner.

A further favorable solution provides that the transition between the second region and the third region proceeds zigzag-shaped at least in some portions. On the one hand, such a zigzag-shaped course is easy to establish. On the other hand, the same has only very small regions which proceed perpendicularly to the cylinder longitudinal axis. Especially the regions proceeding perpendicularly to the cylinder longitudinal axis can result in an oil film interruption when the piston rings slide over the transition.

A further particularly favorable solution provides that an axial extent of a course of the transition between the second region and the third region defines a transition region between the second region and the third region, and that the transition region between the second region and the third region has an axial expanse that is greater than 0.5 mm, but that is less than 40 mm, preferentially less than 15 mm. This region represents an optimal compromise between reducing the risk of the oil shortage of the piston rings and the utilizability of the different roughnesses in the second region and the third region.

A particularly favorable solution provides that the second region has a diameter which is greater by 1 to 10 μm, preferentially 1 to 5 μm, than the diameter of the first region. Because of the larger diameter in the second region, a greater oil film thickness can be created as a result of which friction between piston rings and cylinder liners is reduced.

A practical solution provides that the transition between the first region and the second region proceeds continuously over a width. This means that the diameter continuously changes over the width. In particular, the roughness also changes continuously over the width of the transition. Thus, a gentle transition can be achieved.

A further practical solution provides that the transition between the third region and the second region proceeds continuously over a width. This means that the diameter continuously changes over the width. In particular, the roughness also changes continuously over the width of the transition. Thus, a gentle transition can be achieved.

With a method for producing a cylinder liner according to the above description, the invention is further based on the general idea, of initially honing the entire running surface of the cylinder liner in order to introduce honing grooves into the running surface, thereafter machining the second region in order to reduce the roughness in the second region, wherein at least some, preferentially most, of the honing grooves are retained. This can be achieved for example in that some material in the second region of the running surface is removed, wherein the removal is less than the average depth of the original honing grooves. Because of this, most honing grooves are retained so that the equalization of oil according to the invention is present in the transition region. The enlargement of the diameter can take place for example by honing by means of a further honing tool.

Furthermore, the invention is based on the general idea of equipping a reciprocating piston machine with at least one cylinder and at least one piston, which is mounted in the cylinder, with a cylinder liner according to the above description so that the advantages of the cylinder liner are transferred to the reciprocating piston internal combustion engine, to the above description of which reference is made in this regard.

Further important features and advantages of the invention are obtained from the subclaims, from the drawings and from the associated figure description by way of the drawings.

It is to be understood that the features mentioned above and still to be explained in the following cannot only be used in the respective combination stated but also in other combinations or by themselves without leaving the scope of the present invention.

Preferred exemplary embodiments of the invention are shown in the drawings and are explained in more detail in the following description, wherein same reference numbers relate to same or similar or functionally same components.

DETAILED DESCRIPTION

Figure 1:
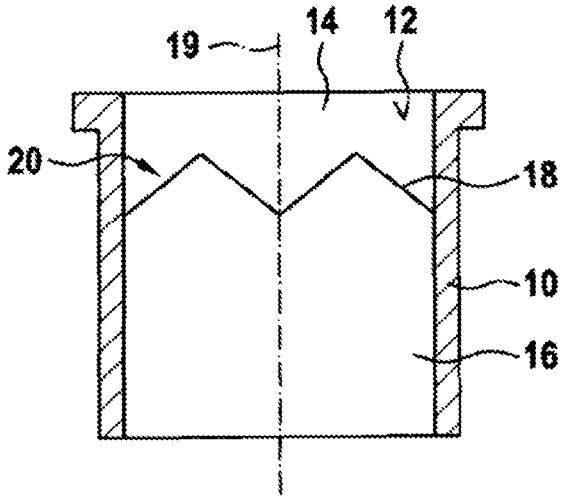
FIG. 1 shows a sectional representation through a cylinder liner according to the invention as per a first embodiment.
Figure 2:
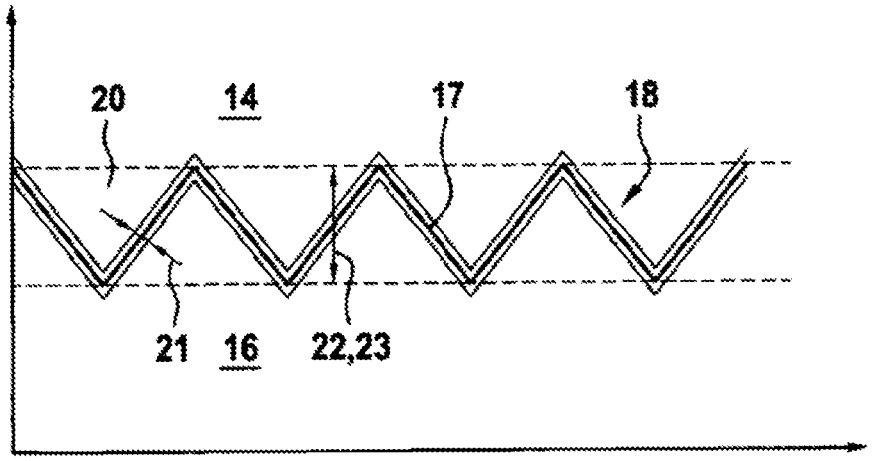
FIG. 2 shows a progression chart of the transition between two regions with different roughness on the running surface, wherein on the X-axis the circumferential direction is shown and on the Y-axis the axial position of the transition is shown.

A first embodiment of a cylinder liner 10 shown in FIGS. 1 and 2 is used in a reciprocating piston internal combustion engine. The cylinder liner 10 has a running surface 12 along which a piston of the reciprocating piston internal combustion engine slides. The piston preferentially comprises at least one piston ring which is in contact with the running surface 12 in order to achieve an optimal seal.

The piston is coupled to a crankshaft resulting in a cyclical up and down movement of the piston. In the process, a top dead center, in which the piston lies in the cylinder liner 10 at a point most distant from the crankshaft axis, and a bottom dead center, in which the piston lies in the cylinder liner 10 at a point that is nearest the crankshaft axis, are obtained.

In the vicinity of the two dead centers, the movement velocity of the piston is low. In the region in between, the movement velocity is greatest.

In order to obtain an optimal lubrication, honing grooves are introduced by honing into the running surface 12, which form an oil retention volume. In order to achieve friction losses that are as low as possible, the running surface 12 of the cylinder liner 10 comprises a first region 14 and a second region 16, wherein the first region 14 has a greater roughness than the second region 16. When comparing the roughnesses, the mean peak-to-valley height $R_z$ is considered. This means that the first region 14 has a greater mean peak-to-valley height $R_z$ than the second region 16.

The reduction of the roughness in the second region 16 is achieved by removing material on the running surface 12. Only so much material is removed that most of the introduced honing grooves are retained even in the second region 16.

By removing the material, the second region 16 has a larger diameter than the first region 14. For example, the diameter of the second region 16 is greater by 1 to 10 μm, preferentially by 1 to 5 μm, than the diameter of the first region 14. It is to be understood that the enlargement of the diameter in the second region 16 has to be less than twice the depth of the honing grooves so that the honing grooves are retained even in the second region 16.

The first region 14 is arranged at an axial end of the cylinder liner 10, which in the installation position later on faces away from the crankshaft. This means that when the piston is located in the region of the top dead center, the piston rings lie in the first region 14. When the piston is located in the bottom dead center or an intermediate region between the two dead centers, the piston rings lie in the second region 16.

In the second region 16, the roughness is less than in the first region 14. Because of this, the friction losses can be reduced in the intermediate region, in which the piston velocity is high. Because of the increased roughness and thus deeper honing grooves, a greater oil retention volume is achieved in the first region 14, so that even with greater normal forces the wear between the cylinder liner 10 and the piston ring can be reduced.

A transition 18 between the first region 14 and the second region 16 proceeds obliquely to a cylinder longitudinal axis 19 at least in some portions. Because of this, regions can be avoided in which the transition proceeds perpendicularly to the cylinder longitudinal axis 19. In the case of a perpendicular course, the piston ring or piston rings would reach the transition 18 simultaneously along the entire circumference of the piston ring. This could lead to an oil film interruption or to undesirably turbulent flows of the oil when the piston rings slide over the transition 18. In addition, a very abrupt force transmission to the piston rings could result.

Through the course that is oblique at least in some portions between the first region 14 and the second region 16, the piston rings gradually slide over the transition 18. This means that in multiple circumferential positions, the piston rings already enter into contact with the transition 18 while other regions of the piston ring are not yet in contact with the transition 18. This results in a transition region 20 in which the piston rings slide over the transition 18. When the piston rings are in the transition region, the piston rings can thus push oil from the first region 14 laterally along the honing grooves or in the circumferential direction into the second region 16 so that an adequate oil lubrication is provided in the second region 16.

The transition 18 itself has a finite width 21, within which the diameter and the roughness change. A course 17 of the transition 18 is defined by the course 17 of the respective center of the width 21 of the transition 18. The transition region 20 is defined by the course 17 of the transition 18. The transition region 20 proceeds in the axial direction over a region which is occupied by the transition 18 in the axial direction. Thus, the transition region 20 is limited in the axial direction by the axial extreme points of the course 17 of the transition 18.

An axial extent 22 of the course 17 of the transition 18 and thus an axial expanse 23 of the transition region 20 is preferentially less than 40 mm, particularly preferably less than 15 mm, however greater than 0.5 mm.

Figure 3:
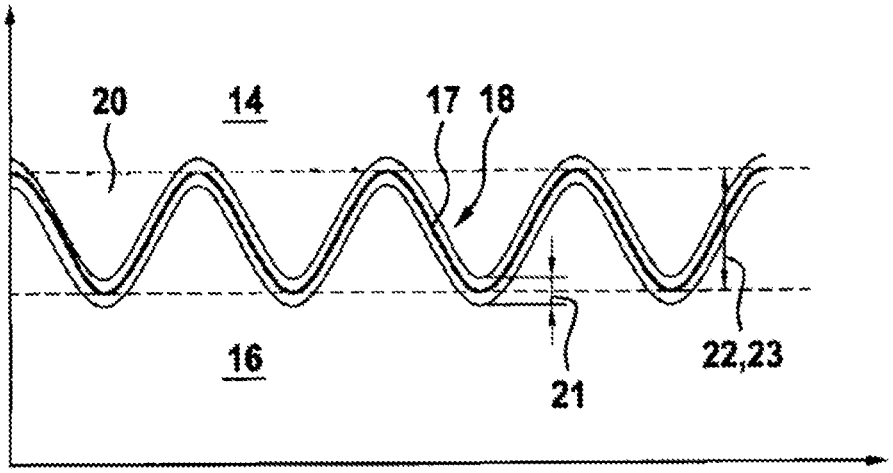
FIG. 3 shows a representation corresponding to FIG. 2, wherein a wave-like course of the transition is shown.
Figure 4:
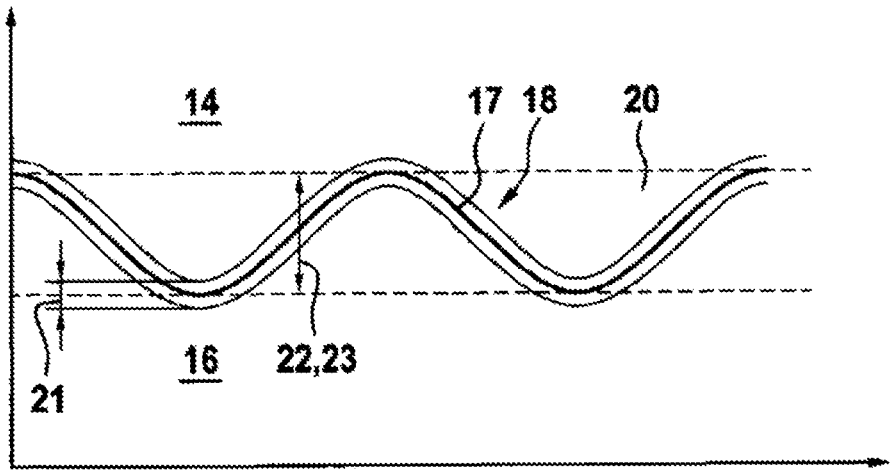
FIG. 4 shows a representation corresponding to FIG. 3, wherein the shown course of the transition only comprises two wave troughs and two wave crests.

A favorable version provides that the course 17 of the transition 18 is zigzag-shaped, such as is shown for example in FIG. 2. It is to be understood that a wave-like course 17, such as shown for example in FIG. 3, is also possible. In FIG. 4, a version with two wave crests and two wave troughs is shown for example.

Figure 5:
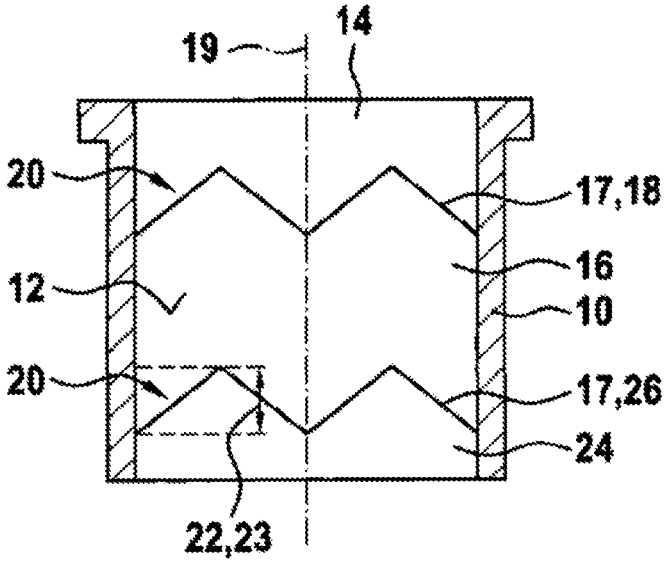
FIG. 5 shows a sectional representation through a cylinder liner according to a second embodiment, wherein three regions with different accuracy values are provided.

A second embodiment of the cylinder liner 10 shown in FIG. 5 differs from the first embodiment of the cylinder liner 10 shown in FIGS. 1 and 2 in that the running surface 12 of the cylinder liner 10 has a third region 24 which has a roughness that is greater than the roughness of the second region 16. Preferentially, a transition 26 between the second region 16 and the third region 24 is also formed obliquely at least in some portions as was described for example regarding the transition 18 between the first region 14 and the second region 16. Thus, the risk of an oil shortage of the piston rings can also be reduced at the transition 26 between the second region 16 and the third region 24. Thus, reference is made in this regard to the above description regarding the transition 18 between the first region 14 and the second region 16.

Otherwise, the second embodiment of the cylinder liner 10 shown in FIG. 5 corresponds to the first embodiment of the cylinder liner 10 shown in FIGS. 1 to 4 in terms of construction and function, to the above description of which reference is made in this regard.

The invention claimed is:

1. A cylinder liner for an internal combustion engine, comprising:

a running surface, in which by honing directed honing grooves are introduced and which has a first region and a second region, wherein the first region has a roughness that is distinct from a roughness of the second region;

wherein a transition between the first region and the second region proceeds obliquely to a cylinder longitudinal axis at least in some portions; and wherein at least some of the honing grooves at the transition between the first region and the second region are uninterrupted.

2. The cylinder liner as claimed in claim 1, wherein the transition between the first region and the second region proceeds at least one of alternatingly and periodically at least in some portions.

3. The cylinder liner as claimed in claim 1, wherein one of:

the transition between the first region and the second region proceeds wave-like at least in some portions; or the transition between the first region and the second region proceeds zigzag-shaped at least in some portions.

4. The cylinder liner as claimed in claim 1, wherein:

an axial extent of a course of the transition between the first region and the second region defines a transition region between the first region and the second regions; and the transition region between the first region and the second region has an axial expanse that is less than 40 mm and greater than 0.5 mm.

5. The cylinder liner as claimed in claim 1, wherein the first region and the second region are axially adjacent to one another.

6. The cylinder liner as claimed in claim 1, wherein:

the first region lies axially eccentrically and the second region lies axially centrically; and the roughness of the first region is greater than the roughness of the second region.

7. The cylinder liner as claimed in claim 5, wherein:

the running surface includes a third region which has a roughness greater than the roughness of the second regions; and the third region is arranged eccentrically, adjoins the second region, and based on an axial center lies opposite the first region.

8. The cylinder liner as claimed in claim 7, wherein a transition between the second region and the third region proceeds obliquely to the cylinder longitudinal axis at least in some portions.

9. The cylinder liner as claimed in claim 8, wherein the transition between the second region and the third region proceeds at least one of alternatingly and periodically at least in some portions.

10. The cylinder liner as claimed in claim 7, wherein one of:

the transition between the second region and the third region proceeds wave-like at least in some portions; or the transition between the second region and the third region proceeds zigzag-shaped at least in some portions.

11. The cylinder liner as claimed in claim 8, wherein:

an axial extent of a course of the transition between the second region and the third region defines a transition region between the second region and the third region; and the transition region between the second region and the third region has an axial expanse that is less than 40 mm and greater than 0.5 mm.

12. The cylinder liner as claimed in claim 1, wherein the second region has a diameter which is greater by 1 to 10 μm than a diameter of the first region.

13. A cylinder liner produced by a process comprising:

honing an entire running surface of an unfinished cylinder liner, such that honing grooves are introduced into the running surface;

after the honing, machining a second region of the running surface to reduce a roughness in the second region such that the roughness is less than a roughness of a first region of the running surface, wherein at least some of the honing grooves in the second region are retained;

wherein a transition between the first region and the second region proceeds obliquely to a cylinder longitudinal axis at least in some portions; and wherein at least some of the honing grooves at the transition between the first region and the second region are uninterrupted.

14. A method for producing a cylinder liner, comprising:

honing an entire running surface of an unfinished cylinder liner such that honing grooves are introduced into the running surface;

after the honing, machining a second region of the running surface to reduce a roughness in the second region such that the roughness is less than a roughness of a first region of the running surface, wherein at least some of the honing grooves in the second region are retained, wherein a transition between the first region and the second region proceeds obliquely to a cylinder longitudinal axis at least in some portions; and wherein at least some of the honing grooves at the transition between the first region and the second region are uninterrupted.

15. The cylinder liner as claimed in claim 1, wherein most of the honing grooves at the transition between the first region and the second region are uninterrupted.

16. The cylinder liner as claimed in claim 4, wherein the axial expanse is less than 15 mm and greater than 0.5 mm.

17. The cylinder liner as claimed in claim 11, wherein the axial expanse is less than 15 mm and greater than 0.5 mm.

18. The cylinder liner as claimed in claim 12, wherein the diameter of the second region is greater by 1 to 5 μm than the diameter of the first region.

19. The cylinder liner as claimed in claim 13, wherein most of the honing grooves at the transition between the first region and the second region are uninterrupted.

20. The method as claimed in claim 14, wherein most of the honing grooves at the transition between the first region and the second region are uninterrupted.

* * * * *